US005124658A

United States Patent [19]

Adler

[11] Patent Number: 5,124,658

[45] Date of Patent: Jun. 23, 1992

[54] NESTED HIGH VOLTAGE GENERATOR/PARTICLE ACCELERATOR

[76] Inventor: Richard J. Adler, 90 Angeles Vista Cir., Sandia Park, N. Mex. 87047

[21] Appl. No.: 575,158

[22] Filed: Aug. 29, 1990

Related U.S. Application Data

[63] Continuation-in-part of Ser. No. 205,724, Jun. 13, 1988, abandoned.

[51] Int. Cl.[5] ..... H01J 23/08

[52] U.S. Cl. ..... 328/233

[58] Field of Search ..... 328/233

[56] References Cited

U.S. PATENT DOCUMENTS 4,808,940 2/1989 Toyota ..... 328/233

4,812,775 3/1989 Klinkowstein et al. ..... 328/233

4,888,556 12/1989 Buttram et al. ..... 328/233

*Primary Examiner*—Sandra L. O'Shea

*Attorney, Agent, or Firm*—Donald D. Mon

[57] ABSTRACT

A high voltage generator/particle accelerator with nested electrostatic generators each of which is sufficiently isolated from its neighbors that insulators between them can efficiently isolate them from one another at respectively lower voltages. The advantages of the greater efficiency of the insulators at lower voltages can be utilized to reduce the bulk of the over-all device.

10 Claims, 5 Drawing Sheets

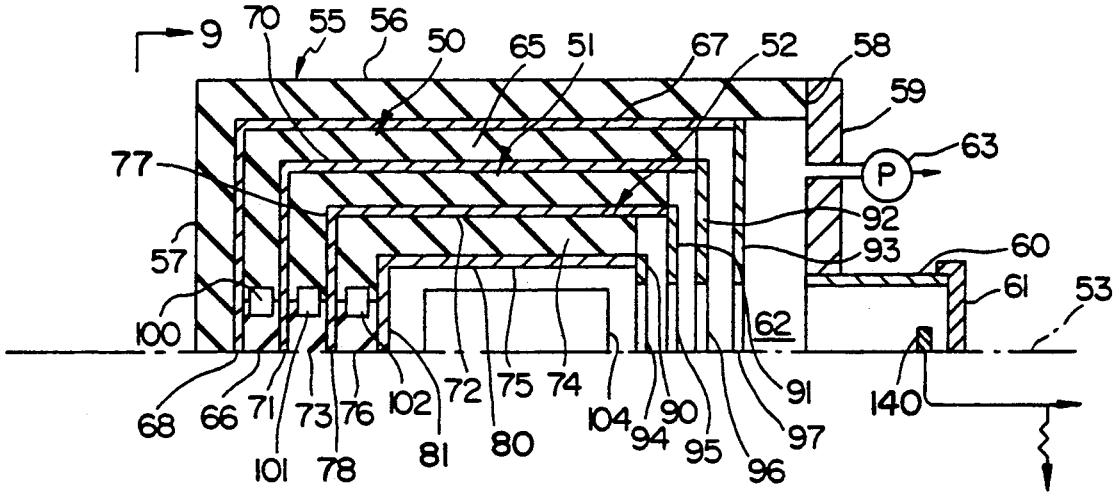
9 FIG. 4

NESTED HIGH VOLTAGE GENERATOR/PARTICLE ACCELERATOR

CROSS-REFERENCE TO OTHER APPLICATION

This is a continuation-in-part of applicant's co-pending U.S. patent application Ser. No. 07/205,724 filed Jun. 13, 1988 entitled "Nested High Voltage Generator/Particle Accelerator", which is now abandoned.

FIELD OF THE INVENTION

This invention relates to a high voltage electrostatic generator and to a particle accelerator which utilizes this generator.

High voltage particle accelerators have a variety of applications in modern technology, including radiation processing, medical isotope production, semiconductor manufacturing, and surface studies. The majority of these applications require energies of 5 MeV or less. In this energy range, electrostatic generators, in which the full accelerating voltage exists across a single insulator or segmented insulator, are the most effective means of accelerating particles. At energies above one MeV, however, electrostatic insulators become extremely large and cumbersome.

The size of the accelerator grows more rapidly than the energy because the electric field strength of insulators decreases with increasing voltage. If this problem can be overcome, more compact electrostatic generators can be developed. In the prior art, the resonant core transformer was developed in order to segment the applied voltage. However, the significance of topologically separating the various voltages was not understood. Similarly, resistive grading can be used to segment voltages. However, the inevitable existence of transients makes the development of pulsed unbalanced voltages unavoidable.

In this patent, there is described a technique which will allow one to utilize the electric field strength of insulators which is available at low voltages to build a high voltage d.c. accelerator. The technique of topologically "nesting" high voltage systems allows one to isolate individual lower voltage systems without developing the full voltage in any one insulator or insulator stack. In a nested system, each voltage generator is disposed inside an adjoining generator. By the laws of electrostatics, these generators are totally isolated if they are separated by a continuous closed piece of metal. In the instant invention, in its embodiment wherein power is supplied externally, only small holes which allow particles to enter and leave the generator, and small slots which control magnetic field penetration are present. In embodiments wherein power is supplied internally by batteries or motor driven generators, even these slots are not needed. In both circumstances one may treat the insulation of each generator separately, with the criteria applicable to lower voltage equipment. This in turn will allow one to reduce the size and complication of d.c. high voltage accelerators. Using this technique, more compact and cost effective electrostatic generators can be developed.

The objective is to provide a class of high voltage generators which makes use of the principles discussed above, thereby to provide novel, effective methods to provide power to individual nested modules. A device which embodies these concepts will be smaller and less expensive than a competing device.

BRIEF DESCRIPTION OF THE INVENTION

The invention is a group of high voltage generators, each inner one encased inside an adjoining outer one, with a power source available to each, a high voltage vacuum insulator, and a sufficiently complete conductive casing separating each pair of supplies. Power can be provided in various ways, the generator construction being adapted to each. Examples are a battery in each generator, power supplied from an external primary transformer winding through magnetic induction to a transformer secondary winding, or through a shaft driven internal alternator.

Such a generator comprises a plurality of such high voltage power supplies. These generators are cup-like and are nested within one another to form an axially-extending assembly. Each of the generators is surrounded by a Faraday cage which sufficiently isolates the generators from one another electrostatically, depending on the type of power source employed.

In some embodiments where the power is supplied externally, the electrostatic isolation is intentionally imperfect, because it will be penetrated by openings to permit flow of magnetic flux, but still will significantly and sufficiently isolate adjacent generators from one another. A primary transformer winding externally of the nested generators is thereby effective to develop a voltage by means of a secondary winding inside each of the generators. In other embodiments of the invention, the Faraday case can be complete, provided the power source is internal.

Insulator means is provided between adjacent generators, so that the voltage across each is only a fraction of the total developed voltage across the entire device. Still, because the insulators are individually operating at a relatively lower voltage, advantage can be taken of the fact that they are more efficient at lower voltages. Accordingly, the device can be made much smaller than if all of the insulators have to resist the ultimate voltage.

BRIEF DESCRIPTION OF THE DRAWINGS

FIG. 4 is an axial half-section showing another embodiment of the invention;

DETAILED DESCRIPTION OF THE INVENTIONS

Figure 1:
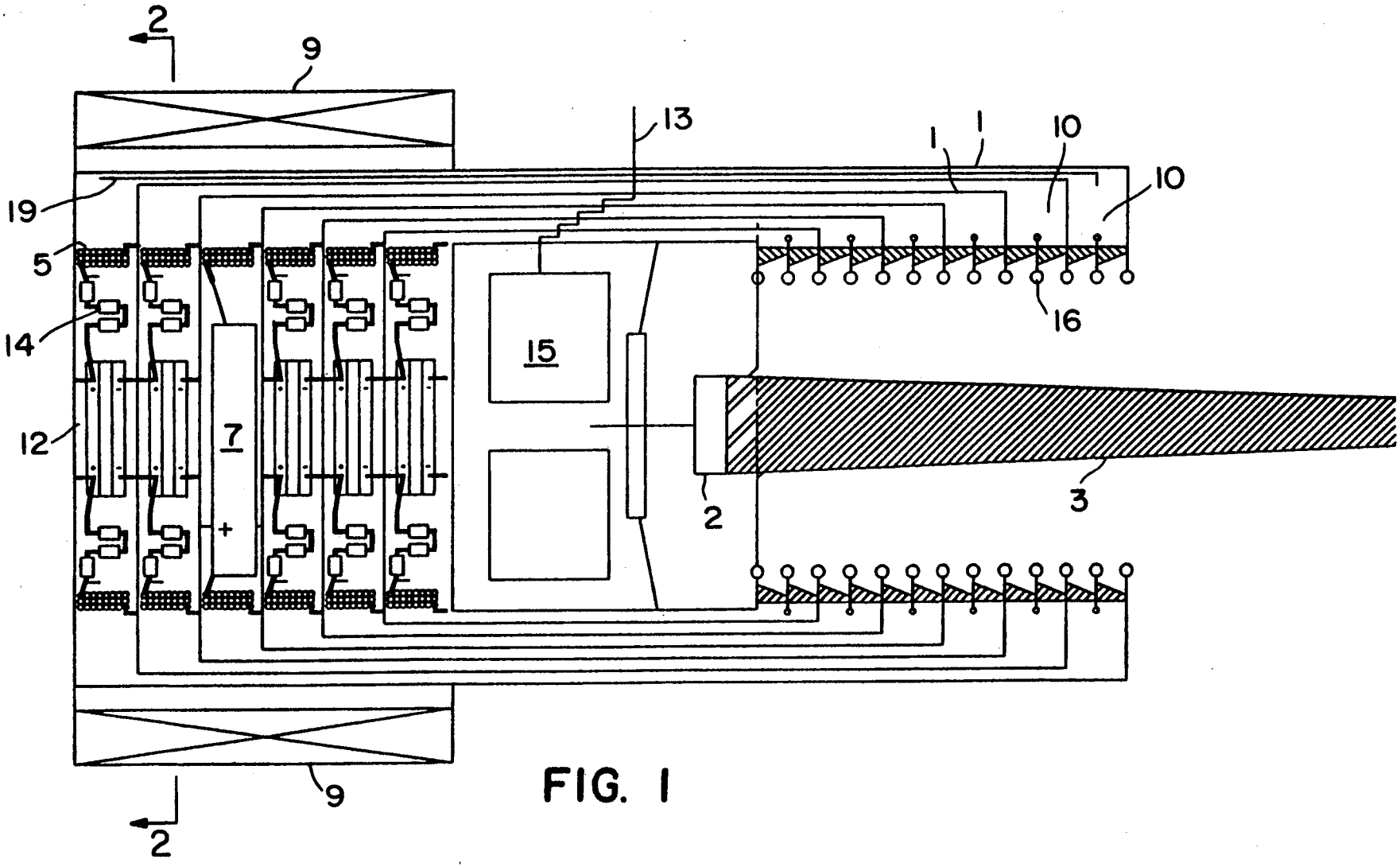
FIG. 1 shows a cross-section of a nested high voltage generator with an inductive power source.
Figure 2:
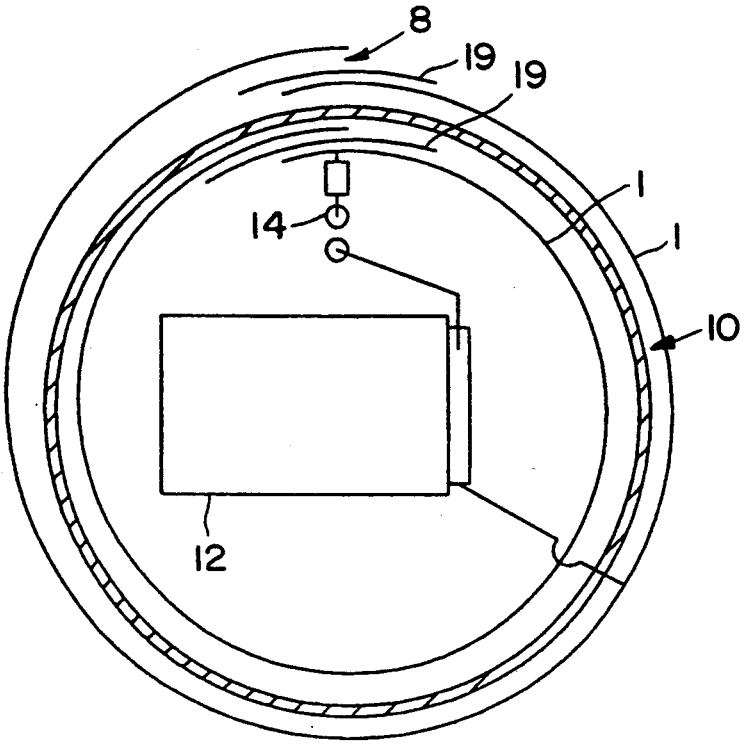
FIG. 2 shows a head-on view of FIG. 1.

There is shown in FIG. 1 a high voltage particle accelerator which operates in accordance with the principles of the invention. It consists of a number of individual high voltage d.c. generators arranged so that each individual generator is completely enclosed inside an adjoining generator, and completely encloses the other adjoining generator. The common wall 1 between adjoining generators is arranged to be a nearly complete conductor with relatively few openings, or many small openings such as in a metal screen. Common walls 1 are separated by oil, gas, solid, or vacuum insulators 10, schematically shown as open spaces between the common walls. The outermost wall 1 has an insulator only at its inside surface. The walls are shown schematically by a single line, rather than with double lines in FIGS. 1 and 2. Openings of note are the slot 8 of FIG. 2 which allows penetration of magnetic flux without unsuitably compromising the electrostatic shielding provided by the conductive walls 1. A conductive patch 19 fits across the overlapping edges of walls 1, but does not close slot 8. This enables magnetic flux to pass, but it assists in electrostatic separation. The winding 5 acts as a transformer secondary and converts the magnetic flux provided by the external generator into alternating electric currents which supply power to power supplies 7. The power supplies, which may be as simple as capacitor 12-diode 14 combinations, or as complex as a switching power supply, provide a high voltage potential difference across respective insulators 10. These insulators, which may be made of dielectric film or an insulating liquid or gas, are designed to hold off the voltage across the module. The complete insulation afforded by the insulator 10 is terminated by vacuum interface 4 which provides a separation between the insulation required for the power supply, and the vacuum required for particle beam acceleration. The insulators may be angled or fluted in accordance with the principles of vacuum insulation.

In the arrangement of FIG. 1, only the particle beam 3 develops the full voltage NVm, where Vm is the individual module voltage. Modules are completely separate since only the beam and the magnetic flux connect them. Thus, a transient which damages one module cannot cause a cascade type of breakdown as in other high voltage generators.

Figure 3:
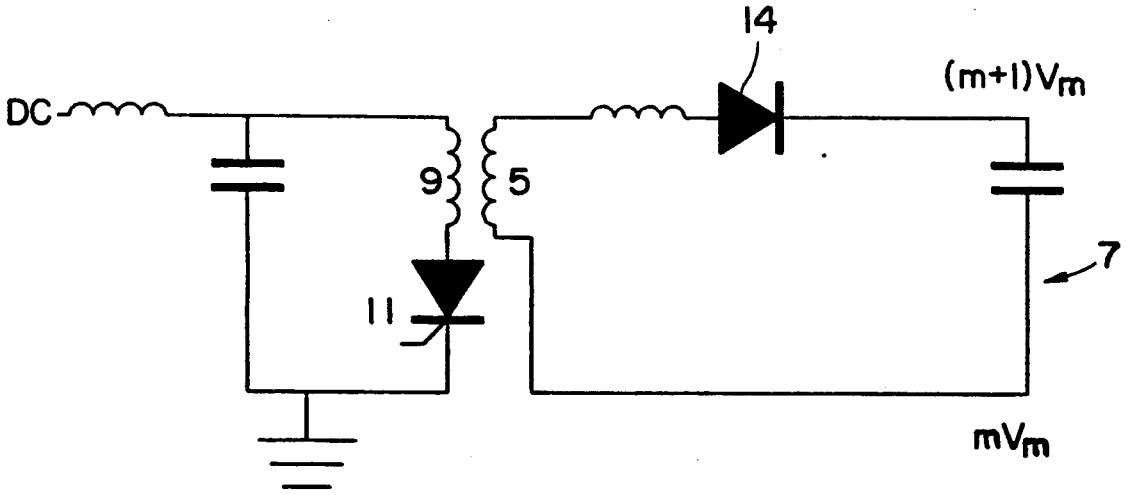
FIG. 3 is a circuit diagram of the primary drive circuit for the generator of FIG. 1.

For the device of FIG. 1, an external circuit is required to supply the magnetic flux which powers the modules, as shown schematically in FIG. 3. In FIG. 3, d.c. power is converted, by means of the power MOSFET switch 11, into a high frequency oscillation suitable for driving the modules through the primary winding 9. In another embodiment of these concepts, power may be supplied by batteries contained in each power supply. A capacitor 12 is required in order to store energy for each pulse of magnetic flux. The voltage for a given beam current is proportional to the power in the external circuit.

The current of the machine is controlled by varying the current in the particle source 2. This may be controlled in turn by a current control 15 under control of a fiber optic link 13. After exiting the particle source, the particles are formed into a particle beam by the particle beam optics 16. Auxiliary beam optics may be built into each module, and deployed in the region of the vacuum insulator 4.

FIG. 4 shows an embodiment of the invention which includes internal power sources. It further shows the vacuum-tight nested structure required for all embodiments.

Nested generators 50, 51, 52 are shown. Each is cup like, and each is nested into its neighbor to form a structure which extends axially along central axis 53.

Figure 9:
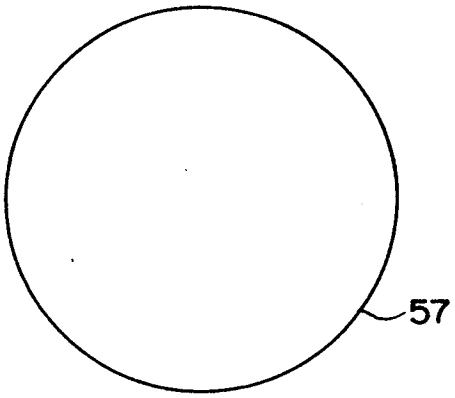
FIG. 9 is an end view of FIG. 6.

An outer shell 55 has a tubular wall 56 and a disc-like base 57 (FIG. 9). Its throat end 58 is closed by a closure 59.

An exit neck 60 with a seal cap 61 closes throat 62 from which particles will be emitted. A vacuum pump 63 is provided to evacuate the enclosure formed by the outer shell and its closure.

Generator 50 includes an insulating tubular wall 65 and an insulating base 66. A tubular conducting outer member 67 is applied to the outer surface of wall 65, and a disc-like conductive outer base member 68 is applied to base 66.

A tubular conductive inner member 70 is applied to the inner surface of tubular wall 65. A disc like conductive inner member 71 is applied to the inner surface of base 66.

Generator 51 has a cup-like insulating structure with tubular wall 72 and base 73. It will be seen that conductive inner members 70 and 71 are also outer members for generator 51.

A similar arrangement is provided for generator 52, in which an insulating cup-like member 74 has a tubular wall 75 and a disc like base 76. A conductive sleeve-like member 77 and disc-like member 78 form common means with generator 51.

An innermost conductive sleeve like member 80 and disc-like member 81 are formed on the inside of insulating means 74.

Thus, these three generators comprise a complete full-area conducting shell on each side of a cup-like insulating structure, each generator (except the outer most and innermost) sharing one of these conductive members.

Conductive stage ending members 90, 91, 92, 93 extend from the conductive members to rings 94, 95, 96, 97 which form throat 62, and act as accelerators for the particles, because of the electrostatic voltage between them.

Power supplies 100, 101 and 102 are provided for generators 50, 51 and 52, respectively. As schematically shown, these may be battery supplied devices which utilize conventional means to generate a high d.c. voltage between each adjacent pair of generators.

Figure 5:
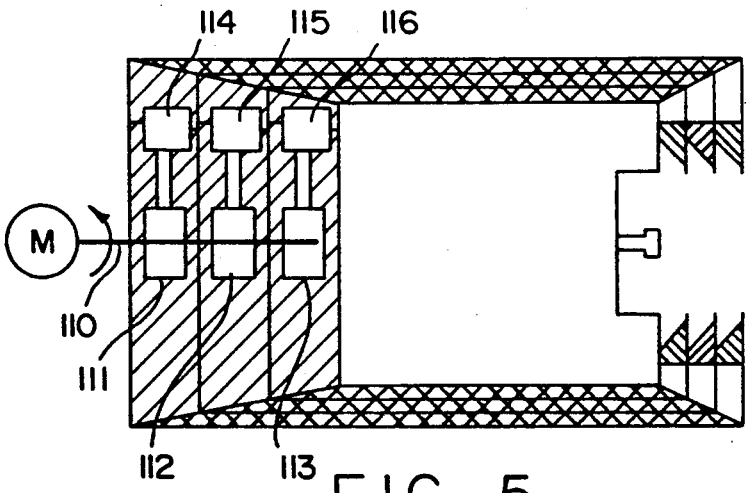
FIG. 5 is an axial cross-section showing yet another embodiment of the invention.

As another example of an internally-contained power supply, FIG. 5 shows a motor-driven powered shaft 110 driving a plurality of rotors 111, 112, 113 with stators 114, 115, 116 to generate a voltage which can be converted to a high voltage d.c. electrostatic voltage. If desired, in all embodiments, capacitors (not shown) can be charged to store energy that is to be released in bursts from the device. Such capacitors are optional.

In all devices which have self-contained power supplies, the Faraday shields will be complete and without gaps.

However, where energy is to be supplied from a power source which is coupled to an external supply, then the Faraday case must be modified in order that magnetic flux coupling is possible, but still with as little degradation of the electrostatic shielding as is possible.

Figure 6:
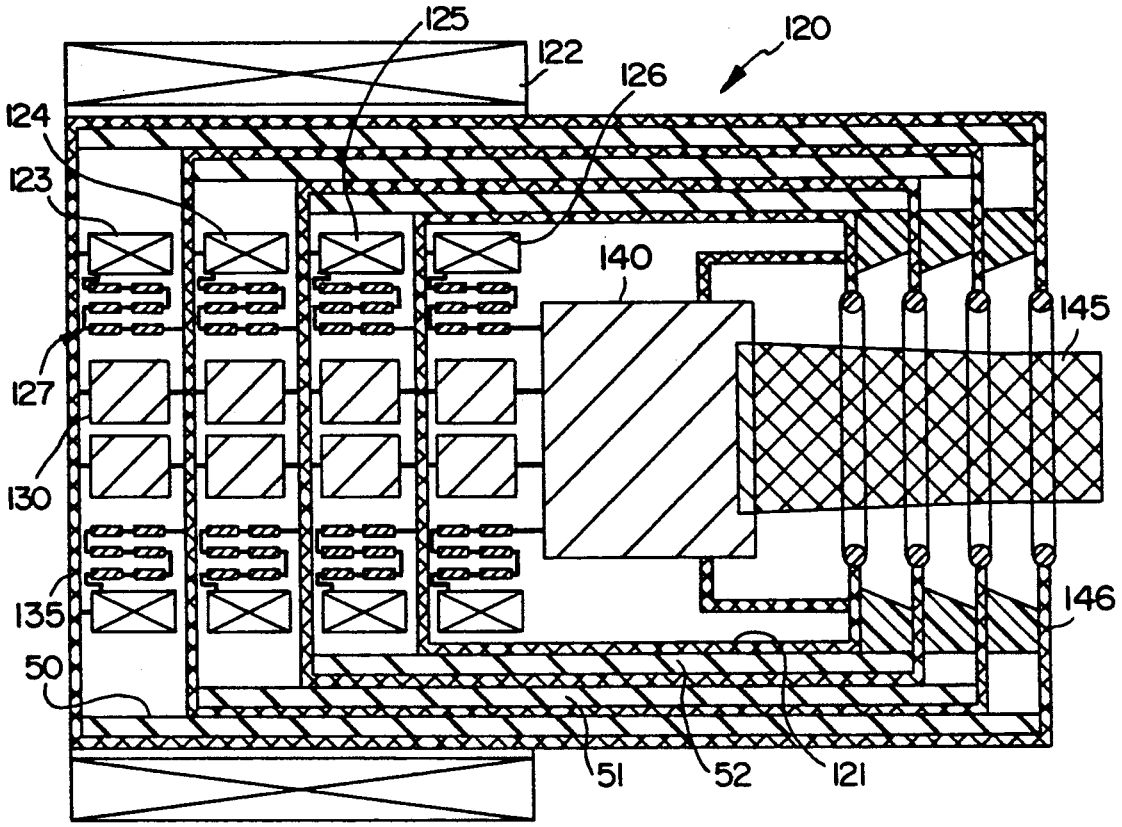
FIG. 6 is an axial cross-section of the presently-preferred embodiment of the invention, which will be recognized as a more detailed showing of the embodiment of FIG. 1.

FIG. 6 is a somewhat schematic showing of a device 120 very similar to that of FIGS. 1 and 4, but modified to accept external power.

In this device, power is derived from a primary transformer winding 122 which encircles it. In this device, the power supply is completed by a secondary winding 123, 124, 125, 126, one for each generator. High voltage conversion devices 127 are provided to convert the ac output from the secondaries to d.c.

Optional capacitors 130 are provided to store energy to be released as desired.

Figure 7:
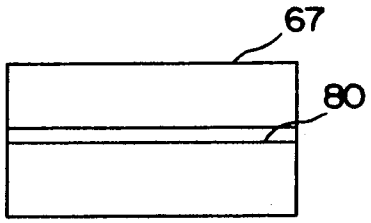
FIG. 7 is a side view of a portion of FIG. 6.

Obviously this device will not function without magnetic flux. This is enabled by providing axial slots 80 (FIG. 7) in the tubular portions of the conductive members, for example in member 67. The conductive members on the bases will have openings, also.

Figure 8:
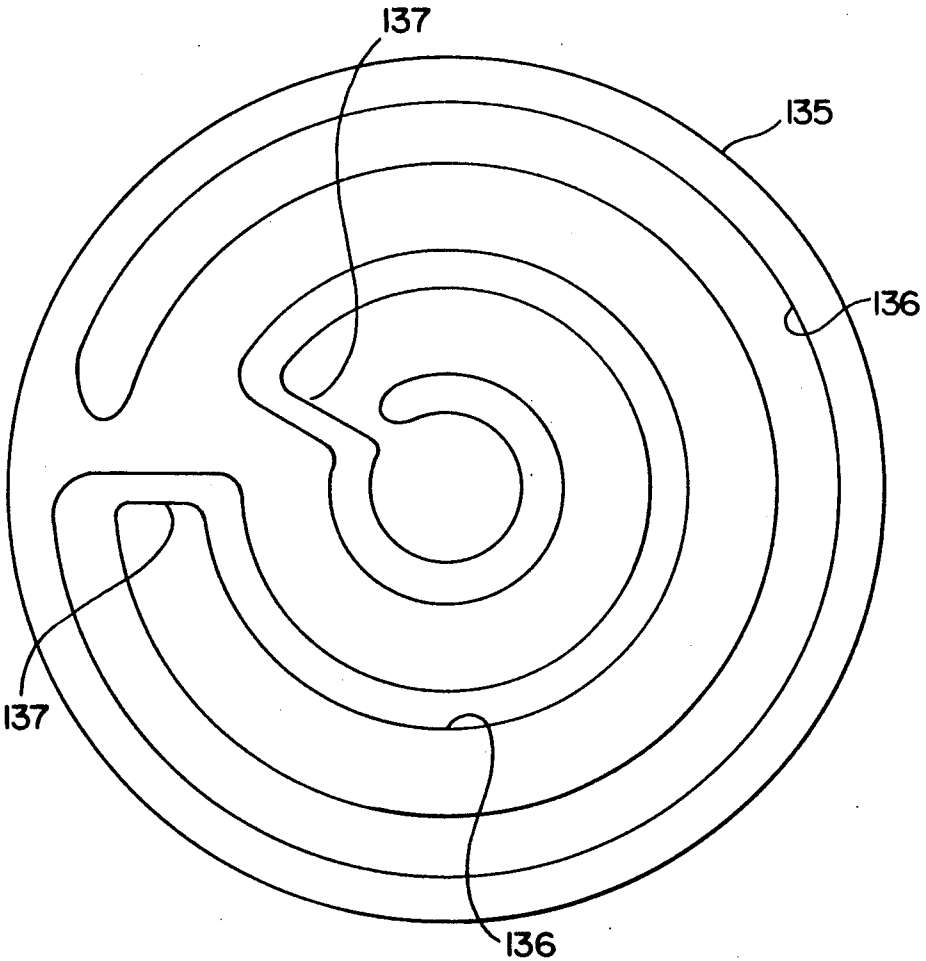
FIG. 8 is a plan view of a portion of FIG. 6.

FIG. 8 shows the presently preferred shape of a conductive metal 135 for the end caps. It includes arcuate segments 136 and radial segments 137. Other forms are also useful, but the illustrated shape appears to provide for gap continuity with the slots in the tubular wall material, and good access to the secondaries through the ends.

The device includes a particle source 140 of any suitable design. Cap 135 is penetrable by the accelerated particles and is selected for that function. Control over the firing of the device can be exerted by any conventional means, including optical techniques.

FIG. 6 also schematically shows beam 145 emitting from the particle source, on its way out of the throat through the emission end 146 of the device.

This invention is characterized by the cup-like nesting of the generators. The auxiliary equipment and control equipment are entirely conventional.

This invention is not to be limited by the embodiments shown in the drawings and described in the description, which is given by way of example and not of limitation, but only in accordance with the scope of the appended claims.

I claim:

1. A modular high voltage particle accelerator having an emission axis and an emission end, said accelerator comprising:

a plurality of high voltage generators in nested adjacency to form a nested stack, each said generator comprising a cup-like housing having a base and a tubular sleeve extending from said base, said base and sleeve being an insulator, and having sufficient field strength and thickness to resist the voltage between its respective generator and its adjacent generator, said base and sleeve having spaced apart surfaces, a conductive member on each of said surfaces to form a Faraday shield, said conductive members having gaps of limited extent to provide for passage of magnetic flux, but still providing substantial electrostatic isolation of adjacent generators from one another, except for the outermost and innermost of them, each of said conductive members being common with two adjacent generators;

a primary transformer winding encircling said nested stack;

a secondary transformer winding between each adjacent pair of housings, magnetically linked to said primary transformer winding through said gaps;

a power supply respective to each of said secondary windings converting alternating voltage from its respective secondary winding to d.c. voltage, each said transformer secondary winding and power supply thereby applying a d.c. voltage between two adjacent conductive members;

said housings at said emission end forming a hollow throat for particle acceleration, said throat being tubular and axial, and including a peripheral conductive stage-ending member facing into said throat for each said housing, said stage-ending members being axially spaced apart and insulated from one another;

a vacuum seal at the emission end of said throat which enables said throat to be evacuated;

a particle source in said throat; and power means to energize said primary transformer winding.

2. Apparatus according to claim 1 in which the gaps in conductive members on said bases comprise arcuately and radially-extending segments, leaving a continuously-connected disc-like remainder.

3. Apparatus according to claim 1 in which the gaps in the conductive members on the tubular members are formed by circumferentially spaced apart ends of axially-extending conductive members.

4. Apparatus according to claim 3 in which a conductive patch member is placed between siad spaced apart ends, radially spaced apart from both of said ends.

5. Apparatus according to claim 1 in which the tubular sleeves are right cylinders, and said conductive members are applied to their opposite surfaces.

6. A modular high voltage particle accelerator having an emission axis and an emission end, said accelerator comprising:

a plurality of high voltage generators in nested adjacency to form a nested stack, each said generator comprising a cup-like housing having a base and a tubular sleeve extending from said base, said base and sleeve being an insulator, and having sufficient field strength and thickness to resist the voltage between its respective generator and its adjacent generator, said base and sleeve having spaced apart surfaces, with the exception of the outermost insulator, a conductive member being provided on each of said surfaces to form a Faraday shield, also, except for the outermost and innermost of them, each of said conductive members being common with two adjacent generators;

a power supply applying a d.c. high voltage between each pair of adjacent conductive members;

said housings at said emission end forming a hollow throat for particle acceleration, said throat being tubular and axial, and including peripheral conductive stage-ending members facing into said throat, said stage-ending members being axially spaced apart and insulated from one another;

a vacuum seal at the emission end of said throat which enables said throat to be evacuated; and a particle source in said throat.

7. Apparatus according to claim 6 in which said conductive members are continuous and imperforate, the bases being disc-like, and the members on the walls being tubular.

8. Apparatus according to claim 6 in which said power supply comprises a battery, and means receiving power from said battery to develop high d.c. voltage.

9. Apparatus according to claim 6 in which said power supply comprises a shaft-driven generator, and means receiving power from said generators to develop high d.c. voltage.

10. Apparatus according to claim 9 in which said shaft-driven generator includes a rotor and a stator for each of said high voltage generators.

* * * * *